United States Patent [19]

Fletcher et al.

[11] Patent Number: 5,012,581

[45] Date of Patent: May 7, 1991

[54] UNIVERSAL UTILITY KNIFE

[75] Inventors: William D. Fletcher, West Springfield; David H. Mallalieu, Springfield; Donald P. Cummings, Sturbridge, all of Mass.

[73] Assignee: Hyde Manufacturing Co., Sturbridge, Mass.

[21] Appl. No.: 335,111

[22] Filed: Apr. 7, 1989

[51] Int. Cl.[5] ..... B26B 3/06; B26B 3/03; B26B 3/08; B26B 1/00

[52] U.S. Cl. ..... 30/162; 30/151; 30/164; 30/320

[58] Field of Search ..... 30/151, 160, 161, 162, 30/320, 164

[56] References Cited

U.S. PATENT DOCUMENTS

| | | | |
|---|---|---|---|
| 2,145,985 | 2/1939 | Krajicek | 30/162 |
| 2,270,655 | 1/1942 | Keeran | 30/162 |
| 2,788,574 | 4/1957 | Marcmann | 30/320 |
| 4,028,758 | 6/1977 | O'Connor | 30/162 |
| 4,068,375 | 1/1978 | Rathbun | 30/162 |
| 4,109,380 | 8/1978 | Anderson | 30/162 |
| 4,139,939 | 2/1970 | Crooks | 30/162 |
| 4,389,776 | 6/1983 | Okada | 30/320 |
| 4,744,146 | 5/1988 | Schmidt | 30/162 |

*Primary Examiner*—Douglas D. Watts
*Assistant Examiner*—Paul M. Heyrana, Sr.
*Attorney, Agent, or Firm*—Lackenbach Siegel Marzullo & Aronson

[57] ABSTRACT

A utility knife especially suitable for use by either right-handed or left-handed persons includes a generally symmetrical casing, as viewed from the side, having a generally pointed leading edge and two surfaces sloping back at equal angles from the point. When a standard

4 Claims, 3 Drawing Sheets

UNIVERSAL UTILITY KNIFE

BACKGROUND OF THE INVENTION

This invention relates generally to knives of the type having a razor blade as the cutting portion and more particularly to a utility knife having an extendable and retractable blade which snaps back into the handle when the user releases his finger from an external thumb piece or knob. There have been many utility knives provided in the prior art. Such knives usually include a casing having a slidable razor blade therein with an external thumb piece connected to an internal carriage whereon the blade is mounted. Using the thumb piece, the user can slide the blade in and out of the casing through a slot at one end of the casing for the purpose of opening cardboard cartons and the like.

However, the knives are as sharp as a razor and such prior art knives are found to be dangerous and may accidentally cut the person using the knife because once the blade projects to the extent desired, the blade stays in its exposed position until it is deliberately and manually retracted.

An improvement in such construction is disclosed in U.S. Pat. No. 4,139,939, issued Feb. 20, 1979, for a utility knife which provides spring-loading on the carriage, such that when the blade has been extended from the casing by operation of the thumb piece, and the user releases the thumb piece, the blade snaps back automatically into the casing where it is completely concealed.

Nevertheless, this improved utility knife still has a major disadvantage in that a knife which is conveniently used by a right-handed person, is extremely inconvenient, in fact awkward, to use by a left-handed person. This occurs because the thumb piece lies on the broad, generally flattened side surface of the knife casing. This side surface is generally parallel to the plane of the razor-sharp blade and the forward end slot. Such flattened side surfaces of the casing make for a firm and comfortable grip.

Heretofore, manufacturers of utility knives of the type disclosed in the patent mentioned above, have provided the market with two models, a right-handed and a left-handed model, these models being mirror images of each other. The need for two models creates tooling problems for the manufacturer and inventory problems for the manufacturer, wholesalers and retailers.

What is needed is a universal utility knife with a razor-blade type cutting blade which retracts automatically into the casing and which can be used with equal facility by right-handed and left-handed persons.

SUMMARY OF THE INVENTION

Generally speaking, in accordance with the invention, a utility knife especially suitable for use by either right-handed or left-handed persons is provided. The utility knife includes two complementary halves forming a complete casing, the halves being secured together by a single screw or similar fastener. One casing half has a relatively short guideway on its inner side in which a blade platform or carriage, a flat piece of material, is slidingly guided moving against the force of a spring. The spring normally maintains the blade platform in a blade-retracted position. A thumb piece extends through an aperture in the wall of the same casing half and connects to the blade platform, such that they move together. The thumb piece is located in a recessed region of the external surface of the casing half. One end of the recessed region forms a stop for the thumb piece so that the thumb piece can only be advanced over a predetermined distance, for examples, ¼ inch or 5/16 inch. This stop limits projection of the blade, which is mounted to the blade platform, when the thumb piece is advanced to strike against the stop. The blade exits the casing through a slot as the thumb piece is advanced.

The front end of the assembled casing, as viewed from the side, is generally symmetrical, having a generally pointed leading edge and two surfaces sloping back at equal angles from the point, that is, sloping outwardly and toward the rear of the casing. When the razor-like blade is positioned and held to the blade platform, the midpoint of the blade's height, measured between its sharpened cutting edge and non-sharpened opposite edge, lies on an imaginary line extending from the point at the forward end of the casing and generally through the center of the knife. The blade may be positioned on the blade platform with its cutting edge being on one side or the other side of the imaginary centerline, as described. In either position, the cutting edge of the blade will project from the casing when the thumb piece is pushed toward the forward end.

Thus, a universal utility knife is provided which can be used by a left-handed person with the blade in one orientation, and by a right-handed person when the blade is turned over about an axis parallel to the blade's cutting edge and repositioned on the blade platform. In both instances the casing surfaces diverging from the central forward point act as cutting guides for the user. The projection of the blade is sufficient for opening most cartons, cutting tape, severing cords and strings, as is done in supermarkets, etc. and is also useful for other purposes where an exceedingly sharp knife is required, with a short blade extension.

The thumb piece is provided with a frangible tab or projection which acts as the stop, limiting projection of the blade when the thumb piece is advanced. Breaking off this tab allows projection of the blade to a greater extent.

Accordingly, it is an object of this invention to provide an improved utility knife which is usable with equal facility by both left-handed and right-handed persons.

Another object of this invention is to provide an improved utility knife which provides a guiding surface while cutting to steady the knife in use by either left-handed or right-handed persons.

A further object of this invention is to provide an improved utility knife for left and right handed use which includes a conventional blade identical to those used in prior art one-handed utility knives.

Still other objects and advantages of the invention will in part be obvious and in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
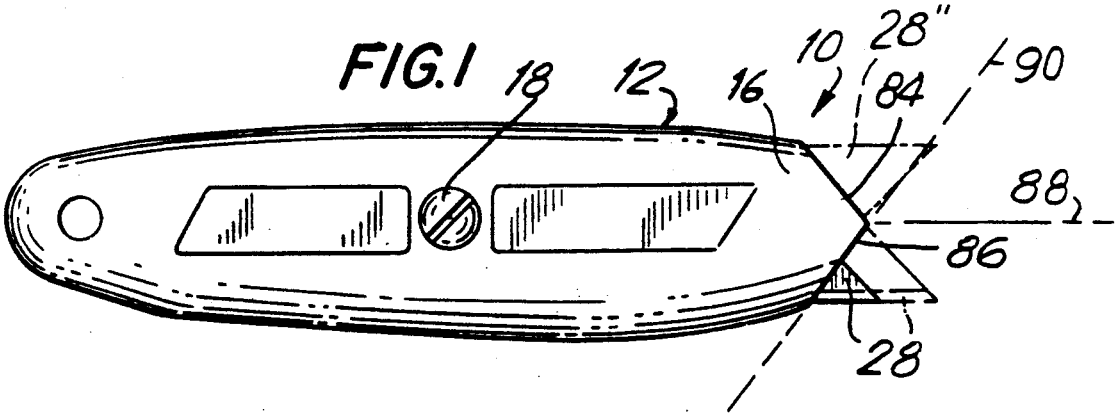
FIG. 1 is a side elevational view of a universal utility knife in accordance with the invention, illustrating a normal and a maximum projection for the knife blade.

With reference to the Figures, the utility knife 10 in accordance with the invention includes a casing 12 having a right half 14 and a left half 16 held together by a machine screw 18 which passes through a clearance hole 20 in the left half 16 and engages a threaded hole 22 in the right half 14. Additionally, guide pins 24 project and engage in opposed guide sockets 26, assuring proper alignment of the casing halves 14, 16 when they are brought together prior to tightening the machine screw 18.

A blade 28 has a razor-sharp cutting edge 30, a central opening 32 and an unsharpened opposed edge 34 on the opposite side of the opening 32 from the cutting edge 30.

Figure 6:
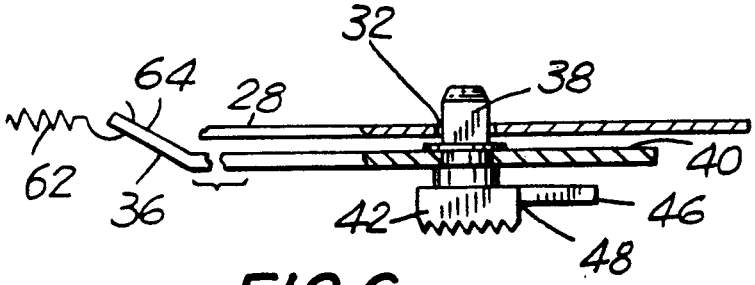
FIG. 6 is a view to an enlarged scale of the attachment between the blade, blade support, and thumb piece with frangible tab thereon.
Figure 7:
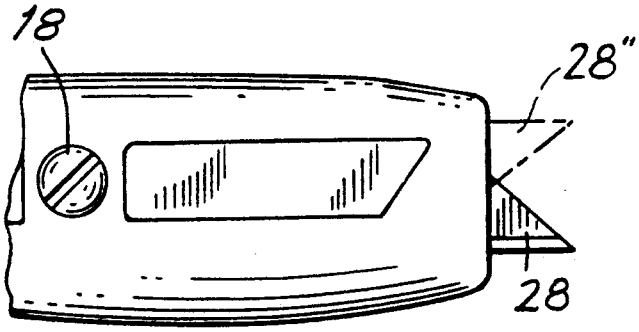
FIGS. 7-8 are fragmentary side views of alternative embodiments in accordance with the invention and FIG. 9 shows a side elevation view of the utility knife in accordance with the present invention showing, schematically, hand operation of a thumb piece on a side of the knife casing.
Figure 8:
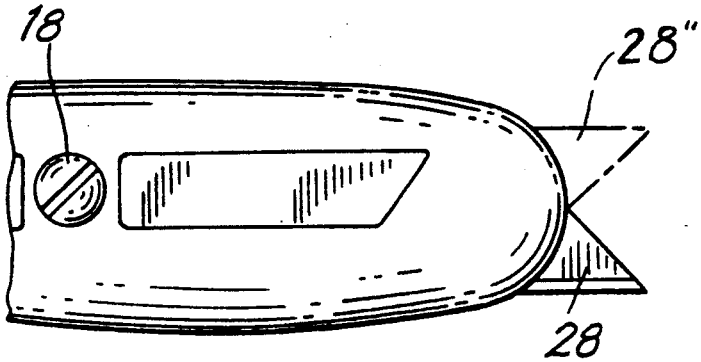
Figure 9:
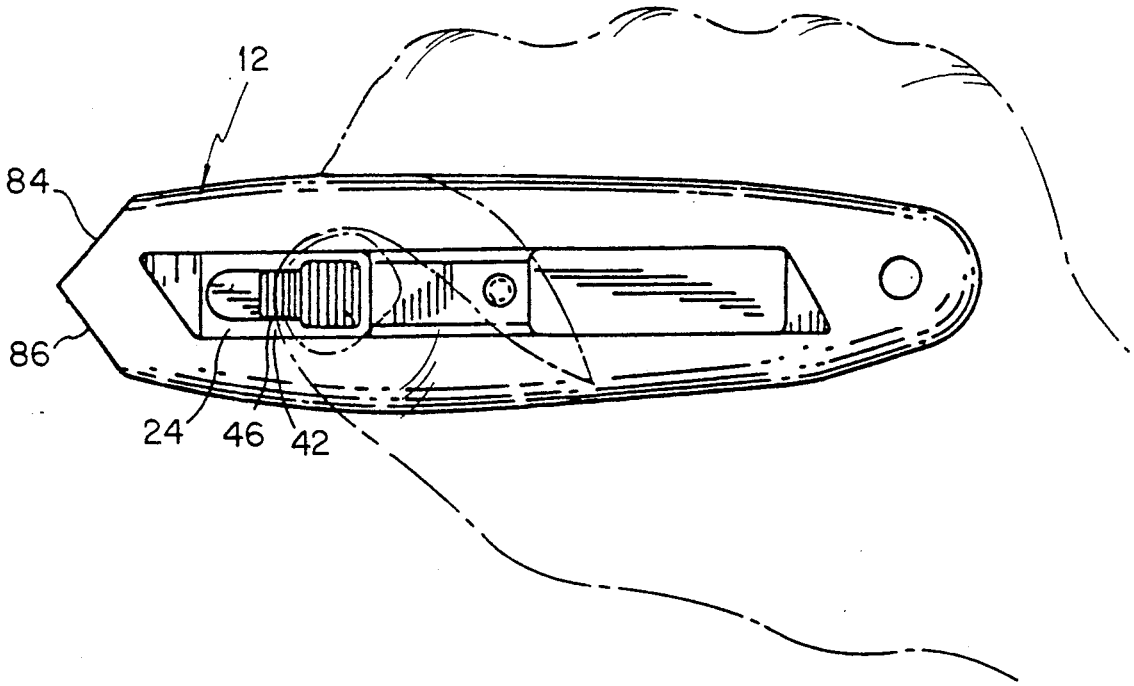

The blade 28 is connected to a platform 36 or carriage by means of a rectangularly shaped post 38, which extends from a flat surface 40 on the platform 36 and passes through the central opening 32 in the blade 28. As illustrated in FIG. 6, a thumb piece 42 is connected to the rectangular post 38, and to a forwardly extending tab 46. The post 38 extends through an elongated oval shaped slot 44 in the casing half 14 to make engagement with the thumb piece 42, which is located in an external recess 50 on the casing half 14. The thumb piece 42 and tab 46 meet at an intersection line 48 along which the tab 46 and thumb piece 42 are selectively separable, as explained more fully hereinafter.

As in the above-referenced patent, the platform 36 slides on a bearing surface 52 and between raised guides 54, 56. The guides 54, 56 join together in a curved surface 58 which corresponds in contour with the forward end of the platform 36. The machine screw 18 passes through an elongated oval slot 60 in the platform 36 and provides longitudinal guidance for the motion of the platform 36 at the rear portion thereof.

Figure 4:
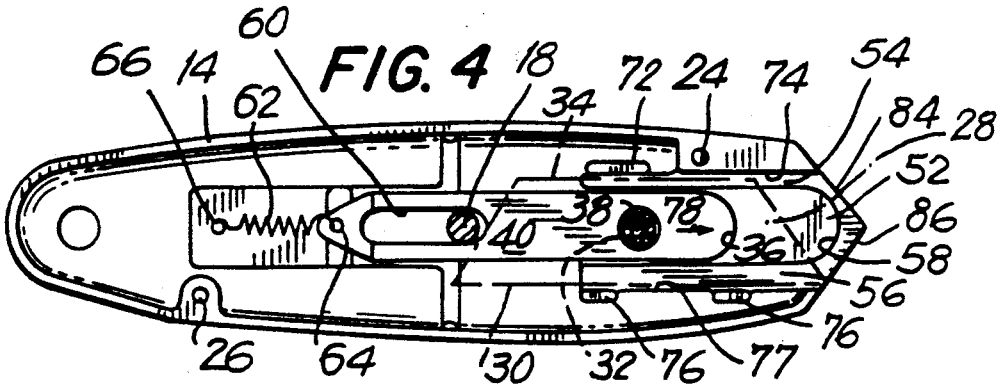
FIG. 4 is an interior view in elevation of the casing half illustrated in FIG. 2.
Figure 5:
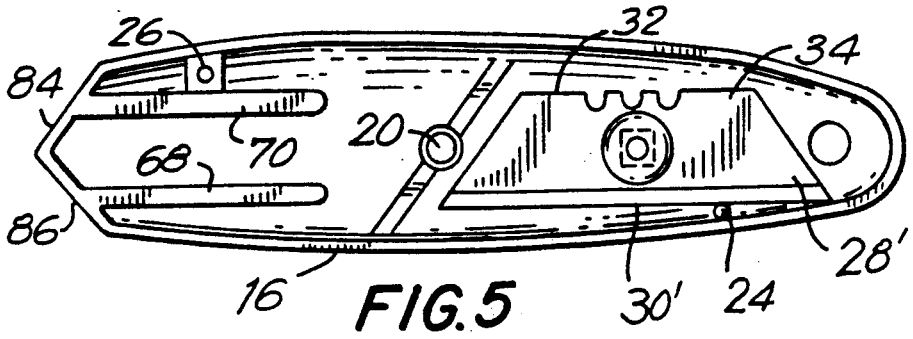
FIG. 5 is a view similar to FIG. 4 but showing the interior of the casing half shown in FIG. 1.

A spring 62 engages an opening 64 at the rear end of the platform 36. The other end of the spring is connected to a post 66 extending inwardly on the casing half 14. The spring 62 biases the platform 36 with its connected blade 28, such that the blade 28 is always entirely withdrawn within the casing 12 when no pushing force is applied to the thumb piece 42. In such a condition, the blade 28 is in a position as indicated with broken lines in FIG. 4. The blade itself resets on the guides 54, 56 and is sandwiched between corresponding opposed guides 68, 79 on the opposite casing half 16.

Additionally, the opposed unsharpened edge 34 of the blade slides adjacent a standing post 72 and an elongated surface 74, both of which rise from the level of the raised guides 54, 56. The cutting edge 30 of the blade 28 is constrained by standing posts 76. When the thumb piece 42 is advanced in the direction of the arrow 78, the blade emerges from the casing 12 through the front slot 80. The blade 28 is not shown in FIG. 3.

Figure 2:
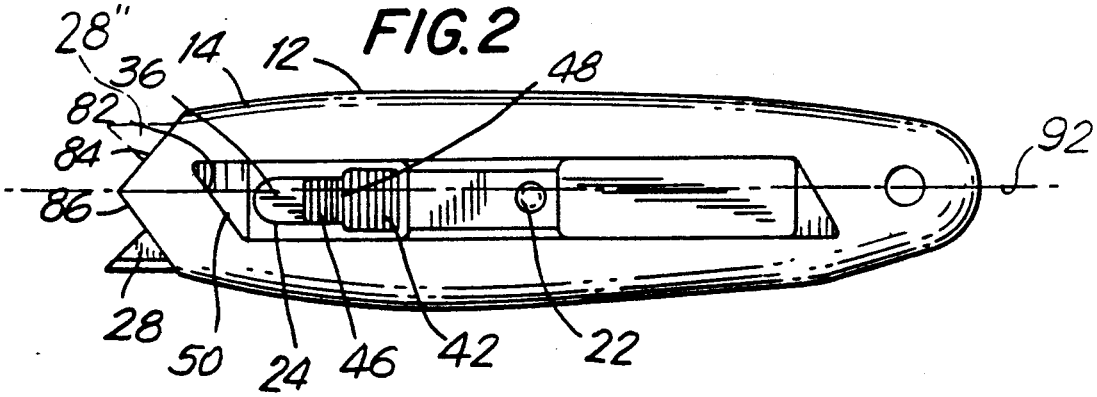
FIG. 2 is an elevational view of the other side of the utility knife of FIG. 1.
Figure 3:
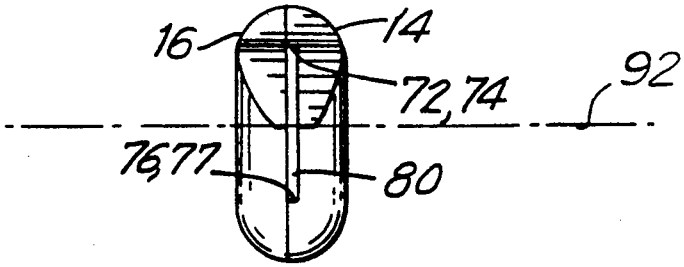
FIG. 3 is a front end view of the utility knife of FIG. 1.

When the thumb piece 42 is pushed in the direction of the arrow 78, the post 38 moves in the elongated opening 44 until the tab 46 strikes the forward edge 82 of the recess 50, thus limiting the blade extension as indicated by the solid lines in FIG. 1 and by the broken line in FIG. 2. If further blade extension is desired, the tab 46 is broken off along the intersection line 48. Then, the thumb piece 42 can be advanced in the direction of the arrow 78 until the thumb piece itself strikes the forward edge 82 of the recess. In such case, the blade 28 is further extended as illustrated with the broken lines in FIG. 1. The external casing surfaces of 14 and 16 surrounding the slot 80 have symmetry about an imaginary plane 92, as shown in FIGS. 2 and 3, which is oriented parallel tot he sliding direction of the blade 28, and intersects slot 80 at a right angle to the length of the slot when the slot is viewed in the sliding direction.

When the user releases his finger, or its pressure, from the thumb piece 42, the spring 62, which has become further extended by advancement of the thumb piece 42, draws the platform 36 back in a direction opposite to the arrow 78. The blade is automatically withdrawn entirely within the casing 12. This withdrawal is complete whether or not the tab 46 has been removed.

The post 38 to which the blade 28 connects, is substantially centered between the blade guide surfaces 76, 77, 72, 74, such that the blade 28 may be flipped over from its illustrated position, about an imaginary axis paralleling the cutting edge 30, and still engage the post 38, be guided by the raised guides 54, 56, 68, 70 and fall between the surfaces 74, 77 and the posts 72, 76. In other words, the cutting edge 30 can be positioned adjacent to the standing post 72 and elongated surface 74 with the opposed dull edge 34 resting against the posts 76 and guiding surface 77.

With the blade reversed, for reversed hand orientation as described (and illustrated) at 28'' in FIGS. 1, 2, 7 and 8), the cutting edge 30 is adjacent the forward face 84 in FIG. 1 and FIG. 2, whereas as presently illustrated the cutting edge 30 appears adjacent forward face 86. The forward faces 84, 86 are symmetrically arranged around an imaginary longitudinal centerline 88, so that the relationship between the cutting edge 30 of the blade 28 and an adjacent external surface 84, 86 is the same regardless of the blade orientation on the post 38. Thus, the blade 28 has the same effectiveness and the knife 10 has the same feel when assembled for a right-handed person as when assembled for a left-handed person.

In cutting a cardboard carton with the blade 28 extended, it is convenient for the user to have the blade 28 penetrate until the carton surface 90 rides along the forward face 86, as illustrated in FIG. 1, or along the forward face 84 if the blade 28 is reversed from that which is illustrated.

The features for mounting a spare blade 28' within the casing 12 are the same as those described in the above-referenced patent, and are not considered to be a novel portion of the invention described herein. The blade 28 is preferably a standard utility knife blade commercially available from many sources including the assignee of this application.

Although the utility knife 10 in accordance with the invention has been illustrated with a symmetrically pointed forward end, in alternative embodiments in accordance with the invention (FIGS. 7, 8) the forward end may have the point rounded or the front may be flat, round, or any other generally symmetrical surface about the centerline 88 as suits the usage, such that a left-handed or right-handed person may use the knife 10 with equal facility.

The blade 28 described above has a square or circular opening 32 which is centered between the opposed edges 30, 34. It should be understood that in alternative embodiments in accordance with the invention, the opening may be another shape, for example rectangular, so long as the blade is guided against tilting as it moves through the slot 80 regardless of the right or left handed blade position.

In other alternative embodiments in accordance with the invention, the return spring 62 is omitted. In such constructions right and left hand selection is available but the blade 28 once extended remains extended until force is applied to the thumb piece 42 to slide the blade back into the casing 12.

In all embodiments in accordance with the invention, the thumb piece 42 slides forward each time to see same stop position when force is applied thereto without any conscious participation of the user in determining the stop position and its associated blade extension.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention in which, is a matter of language, might be said to fall therebetween.

What is claimed is:

1. A utility knife comprising:

a casing assembly comprising two separable complementary halves secured together by a fastener for enclosing a removable slidable blade therein, said blade being slidable back and forth and having a cutting edge extending parallel to the direction of sliding, and a non-cutting edge opposite to said cutting edge, said casing assembly having an elongated slot at one end thereof, the length dimension between a first and a second end of second slot at least equaling the dimension of said blade between said cutting and non-cutting edges;

means for selectively aligning a blade with said slot, a portion of said blade and said cutting edge being subject to protruding from said slot when a blade is slid in one said direction toward said one slotted casing assembly end, said blade being selectively alignable with said cutting edge closer to one of said first slot end and said second slot end upon being removed from said casing assembly and reversed by being turned about an axis parallel to the cutting edge of the blade;

means, including a thumb piece, arranged externally on one side of said casing assembly for sliding said blade, said blade being in either selected blade alignment, said means for sliding responding to application thereto of an external force on said thumb piece; and means for automatically retracting a protruded blade and maintaining said blade within said casing assembly when said external force is released.

2. A utility knife as claimed in claim 1, wherein said casing as viewed from the side is generally symmetrical and has a pointed leading edge from the slotted end toward the rear of the casing.

3. A utility knife as claimed in claim 1, wherein said means for sliding said blade is arranged on one side of said casing and includes a thumb piece adapted to slide said blade upon application thereto of an external force from a thumb of a hand gripping said casing.

4. A utility knife comprising:

a casing assembly comprising two separable complementary halves secured together by a fastener for enclosing a removable, slidable blade therein, said blade being slidable back and forth and having a cutting edge extending parallel to the directions of sliding, and an non-cutting edge opposite to said cutting edge, said casing assembly having an elongated slot at one end thereof, the length dimension between a first and a second end of said slot at least equaling the dimension of said blade between said cutting and non-cutting edges, said casing assembly as viewed from the side being generally symmetrical and having a pointed leading edge sloping from the slotted end toward the rear of the casing assembly;

means for selectively aligning a blade with said slot, a portion of said blade and said cutting edge being subject to protruding from said slot when a blade is slid in one said direction toward said one slotted casing assembly end, said blade being selectively alignable with said cutting edge closer to one of said first slot end and said second slot end upon being removed from said casing assembly and, reversed by being turned about an axis parallel to the cutting edge of the blade;

means, including a thumb piece, arranged externally on one side of said casing assembly, including a thumb piece for sliding said blade, said blade being in either selected blade alignment, said means for sliding responding to application thereto of an external force on said thumb piece; and means for automatically retracting a protruded blade and maintaining said blade within said casing assembly when said external force is released.

* * * * *

UNITED STATES PATENT AND TRADEMARK OFFICE

CERTIFICATE OF CORRECTION

PATENT NO. : 5,012,581

DATED : May 7, 1991

INVENTOR(S) : William D. Fletcher, et al

It is certified that error appears in the above-identified patent and that said Letters Patent is hereby corrected as shown below:

On the title page, the Abstract should read as follows:

A utility knife especially suitable for use by either right-handed or left-handed persons includes a generally symmetrical casing, as viewed from the side, having a generally pointed leading edge and two surfaces sloping back at equal angles from the point. When a standard razor-like blade is positioned in the knife, the midpoint of the blade between its sharpened cutting edge and non-sharpened opposite edge, lies on an imaginary line extending from the point at the forward end of the casing and generally through the center of the knife. The blade may be positioned with its cutting edge being on one side or the other side of the imaginary centerline.

UNITED STATES PATENT AND TRADEMARK OFFICE

CERTIFICATE OF CORRECTION

PATENT NO. : 5,012,581

DATED : May 7, 1991

INVENTOR(S) : William D. Fletcher, et al.

It is certified that error appears in the above-identified patent and that said Letters Patent is hereby corrected as shown below:

In either position, the cutting edge of the blade will project similarly from the casing when a thumb piece is pushed toward the forward end.

Signed and Sealed this

Twenty-ninth Day of June, 1993

Attest:

Michael K. Kirk

MICHAEL K. KIRK

Attesting Officer

Acting Commissioner of Patents and Trademarks